United States Patent [19]

Herrit

[11] Patent Number: 4,936,801

[45] Date of Patent: Jun. 26, 1990

[54] BICYCLE WATERCRAFT ASSEMBLY

[76] Inventor: Dennis W. Herrit, 134 Garfield Ave., Butler, Pa. 16001

[21] Appl. No.: 353,494

[22] Filed: May 17, 1989

[51] Int. Cl.[5] ..... B63H 21/175

[52] U.S. Cl. ..... 440/12

[58] Field of Search ..... 440/11, 12, 26, 27; 114/283

[56] References Cited

FOREIGN PATENT DOCUMENTS

| | | | |
|---|---|---|---|
| 3111630 | 11/1982 | Fed. Rep. of Germany | 440/11 |
| 761122 | 3/1934 | France | 440/26 |
| 34216 | 9/1951 | Poland | 440/12 |

*Primary Examiner*—Sherman D. Basinger
*Assistant Examiner*—Jesus D. Sotelo
*Attorney, Agent, or Firm*—Paul Bogdon

[57] ABSTRACT

A bicycle operated watercraft assembly is disclosed. A bicycle is mounted on a main framework including front and rear outrigger arms to which are secured a pair of laterally spaced floats. The front wheel of the bicycle is disposed in a rotatable channel to which is secured a steerable paddle for controlling the course direction of the watercraft. Propulsion paddles are rotatably secured at the rear of the main framework. The paddles are driven from the bicycle through the drive chain which is operatively connected with a shiftable gear train mounted on the drive shaft for the paddles. The bicycle is secured in place by front and rear struts which are adjustable in length to support different sized bicycles. Rear brackets hold the bicycle against rearward movement during operation.

6 Claims, 2 Drawing Sheets

BICYCLE WATERCRAFT ASSEMBLY

BACKGROUND OF THE INVENTION

This invention relates to a bicycle watercraft assembly wherein a standard bicycle is mounted to a framework including outrigger arms supporting laterally spaced floats.

Paddle propelled pontoon watercraft arranged for pedal operation by a rider are well-known. Various attempts have been made to adapt such watercraft to be operated by a rider motivated bicycle mounted on a suitable framework forming part of the watercraft. The known designs of the bicycle operated watercraft oftentimes arrange the bicycles so that the drive wheel frictionally engage the drive shaft of the paddles. These frictional drive arrangements are deficient since they are subject to slippage and inefficient operations. The slippage becomes pronounced as the bicycle's drive tire experiences wear. It has also been found that the known bicycle watercraft designs are not made to accommodate bicycles of different sizes, and, in addition, are somewhat complex in structure.

My invention overcomes the inherent drawbacks of the heretofore known bicycle watercrafts. My bicycle watercraft provides a direct drive from the bicycle to the drive shaft of the propulsion paddles. The drive chain of the bicycle is connected with a gear assembly mounted on the drive shaft. My direct drive arrangement is also capable of being shiftable among drive gears through the shifting mechanism of the bicycle. My invention also is structured to receive different sized bicycles by making simple adjustments to the support members forming part of the invention. Also, my invention is simply constructed permitting uncomplicated assembly of the parts and rapid assembly and disassembly of the bicycle from the support framework.

SUMMARY OF THE INVENTION

This invention provides a bicycle watercraft assembly which preferably comprises: a conventional bicycle; a main framework rigidly holding the bicycle in place, the main framework comprising a forward section including laterally extending first outrigger arms and a centrally disposed front channel pivotably supported by the first outrigger arms for snugly receiving and holding the steerable front wheel of the bicycle, a rearward section including laterally extending second outrigger arms and a centrally disposed rear channel supported by the second outrigger arms for snugly receiving and holding the rear wheel of the bicycle; front strut members extending from the first outrigger arms to an upper portion of the frame of the bicycle for supporting the bicycle on the framework; rear strut members extending from the second outrigger arms to a rear portion of the frame of the bicycle for supporting the bicycle on the framework; rider-operated rotatable propulsion paddles secured by the second outrigger arms; a steering paddle assembly for the watercraft operatively connected with the pivotable front channel; a gear assembly operatively connected with the drive shaft of the propulsion paddles and the drive chain of the bicycle for imparting a rider motivated driving force from the bicycle to the propulsion paddles; and a pair of laterally spaced floats secured to the outer ends of the outrigger arms for buoyantly supporting the bicycle and main framework. The bicycle may have shiftable gears and a shiftable gear assembly may be connected with the drive shaft of the propulsion paddles, whereby the gears may simply be shifted as desired through the bicycle shifting mechanism. The support struts of my invention may be selectively adjustable in length to connect with bicycles of different sizes. In addition, the front channel which receives the front wheel of the bicycle may be selectively movable frontwardly and rearwardly of the watercraft for accommodating bicycles of different sizes. The steering paddle for the watercraft may be arranged to be selectively vertically positioned. Brackets fixed between the main framework and the rear of the bicycle may be included for preventing rearward movement of the bicycle during its operation.

Various other advantages, details, and modifications of the present invention will become apparent as the following description of a certain present preferred embodiment proceeds.

DESCRIPTION OF THE THE DRAWINGS

In the accompanying drawings I show a certain present preferred embodiment of my invention in which.

DESCRIPTION OF A PREFERRED EMBODIMENT

Figure 1:
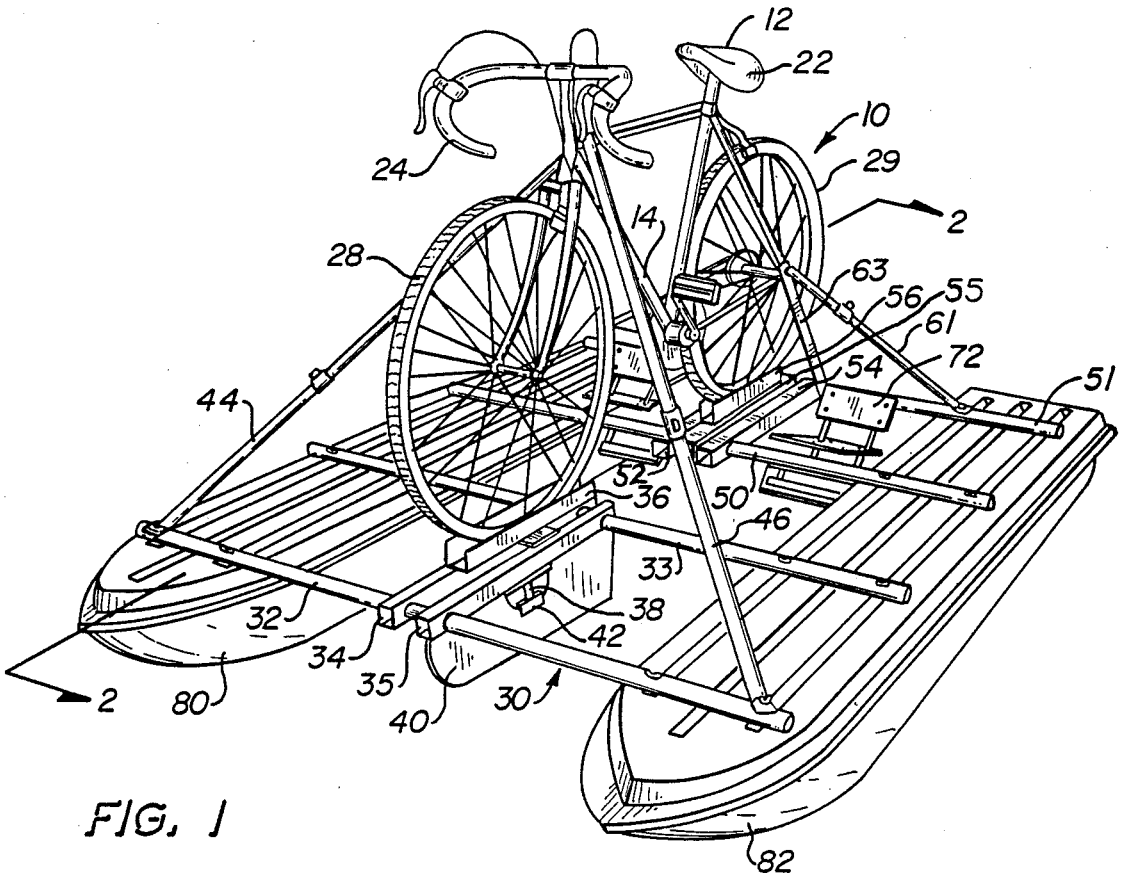
FIG. 1 is a perspective view of a bicycle watercraft assembly embodying this invention.
Figure 2:
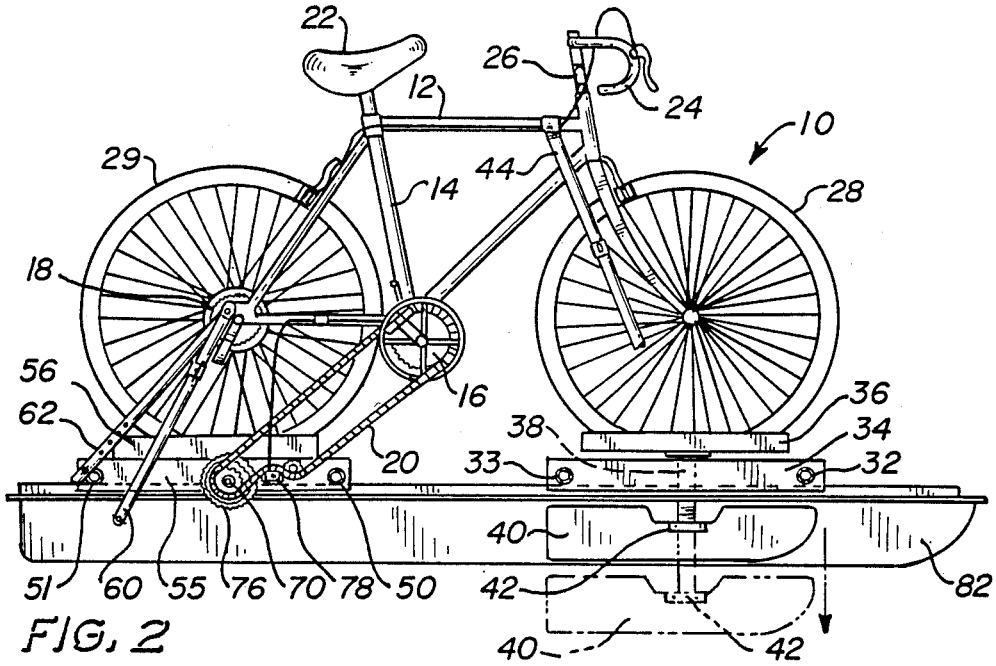
FIG. 2 is a side elevation view of the watercraft of this invention looking along the line 2—2 of FIG. 1, and showing in phantom outline the positioning capability of the steering paddle assembly.
Figure 3:
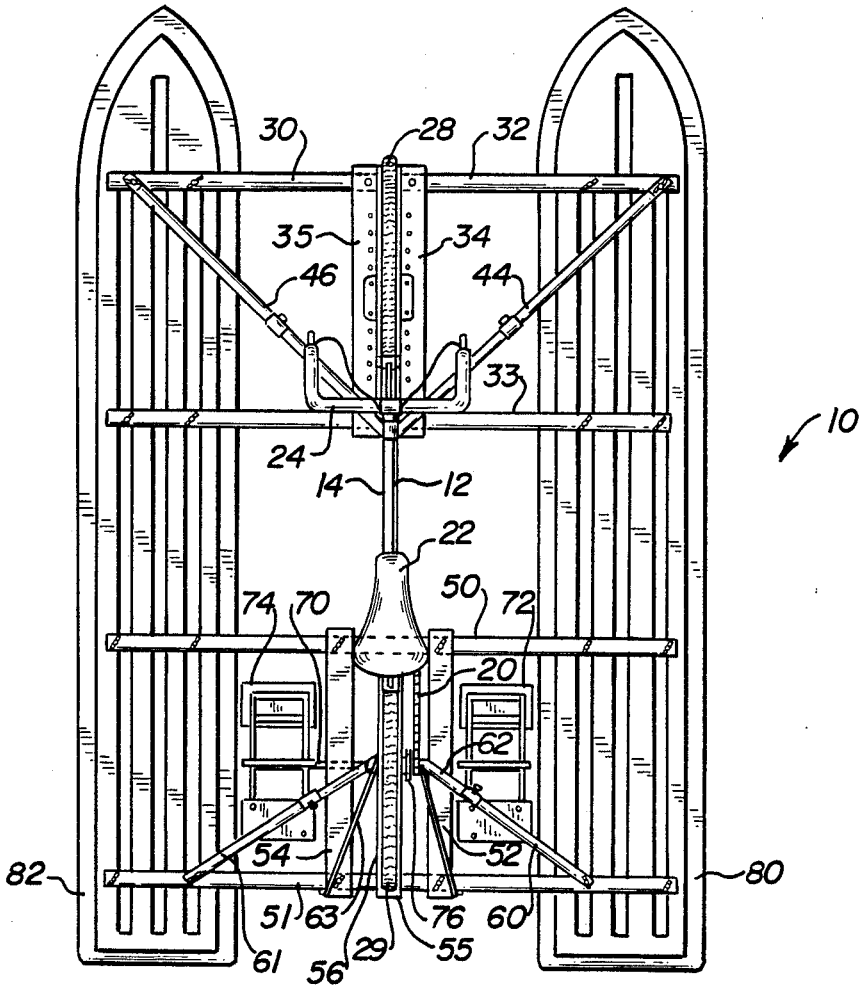
FIG. 3 is a plan view of the watercraft of FIG. 1.

Referring now to the drawings there is shown a bicycle watercraft assembly 10 embodying the present invention. The assembly 10 includes a conventional bicycle 12 which may be a 5-speed shiftable bicycle, having a frame 14 of typical construction, a drive assembly including a pedal motivated drive gear 16 usually connected with a shiftable gear train 18 by a drive chain 20 through a deraileur, not shown but well-known in construction. The bicycle 12 also includes a typical seat 22 and handle bars 24. A gear shift lever 26 is arranged at the front section of the frame 14 and operates a gear shift cable, not clearly shown but of well known construction, for shifting the drive chain 20 among the gears of the gear train 18. The bicycle 12 also includes a steerable front wheel 28 supported by the frame 14 and steerable by twisting the handle bars 24 to pivot the yoke portion of the frame 14, the yoke securing the front wheel 28. There is also a rear wheel 29 which is the drive wheel and it is arranged for rotation in a fixed vertical plane.

The bicycle 12 is arranged on a main framework 30 which includes a pair of generally parallel first or front elongated outrigger arms 32 and 33 extending laterally across the length of the bicycle 12. Centrally disposed and fixed to mid-sections of the front outrigger arms 32 and 33 are a pair of identical parallel box tubes 34 and 35. Arranged between the tubes 34 and 35 is an open channel member 36 to which is fixed a downwardly extending shaft 38 sized to rotate within the confines of the spaced tubes 34 and 35 and to be selectively translated forwardly and rearwardly of the assembly. The shaft 38 is constructed of two sections one of which is selectively slidable with respect to the other whereby the length of the shaft 38 may be vertically varied as desired. Fixed to the shaft 38 is a steering paddle 40 of any well known shape and configuration for steering the course of the the watercraft. Centrally of an upper portion of the steering paddle 40 is a collar 42 through which removable bolts or the like are arranged. The collar 42 is fixed by the bolts to the shaft 38. The channel member 36 is sized to snugly receive the front wheel 28 of the bicycle 12. By turning the handle bars 24 the turning force will be transmitted to the front wheel 28 and then to the rotatable channel member 36 and then to the steering paddle 40 whereby the rider will cause the watercraft to be steered on a desired course while in a body of water.

Figure 4:
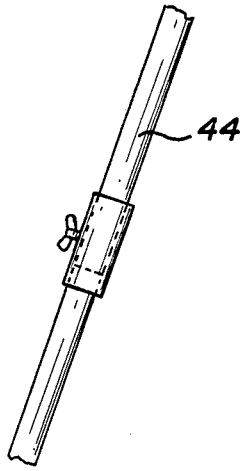
FIG. 4 is a partial elevation view of one of the support struts of the the watercraft of FIG. 1, showing details of construction.

Fixed to the outer ends of the forwardmost front outrigger arm 32 are identical elongated struts 44 and 46 which extend to and are fixed to the horizontal cross-bar of the frame 14 of the bicycle 12. The struts 44 and 46 serve to support the bicycle 12 in a fixed relationship to the main framework 30. The struts 44 and 46 have a telescope two-tube construction as shown in FIG. 4 whereby the tubes may be selectively lengthened or shortened with respect to each other for use with bicycles of different sizes.

The main framework 30 also includes a pair of generally parallel second or rear elongated outrigger arms 50 and 51 extending laterally across the length of the bicycle 12. Centrally disposed and fixed to mid-sections of the rear outrigger arms 50 and 51 are a pair of identical parallel box tubes 52 and 54. A third tube 55 is fixed to the rear outrigger arms 50 and 51 and is arranged between the tubes 52 and 54. Fixed to the central tube 55 is an open channel member 56 sized to snugly receive the rear wheel 29 of the bicycle 12. Channel member 56 is co-extensive with channel member 36 when it is aligned with the channel member 56, whereby the bicycle 12 is oriented to be centrally disposed across the outrigger arms 32 and 33, and 50 and 51. A pair of elongated struts 60 and 61 are fixed at their respective lower ends to inner sections of the rearmost outrigger arm 51. The struts 60 and 61 extend to and are fixed to outer ends of the hub of rear wheel 29 of the bicycle 12. The struts 60 and 61 are telescopic in construction, much like struts 44 and 46, and are selectively adjustable in length to accommodate bicycles of different sizes. Struts 60 and 61 serve to assist in supporting the bicycle in a fixed relationship to the main framework 30. A pair of generally flat elongated brackets 62 and 63 have their lower ends fixed to the rear ends of tubes 52 and 54 and their upper ends fixed to the ends of the hub of rear wheel 29 of bicycle 12. The brackets 62 and 63 serve to secure the bicycle 12 from moving backwardly when the bicycle is being operated. Brackets 62 and 63 are also provided with openings through their lower end sections whereby they may be secured at different locations along their lengths to the tubes 52 and 53 to thereby accommodate bicycles of different sizes.

A paddle propulsion assembly is arranged on the rear end portion of the main framework 30, and includes a drive shaft 70 rotatably extending through and supported by tubes 52, 54, and 55. Arranged on the outer end sections of the drive shaft 70 are identical paddle assemblies 72 and 74. A shiftable gear train 76 is fixed to the drive shaft 70 between the tubes 52 and 55. Supported by the tube 52 is a standard derailleur 78. The drive chain 20 of the bicycle 12 is removed from the gear train 18 and assembled through the derailleur 78 to the gear train 76 on the drive shaft 70. The shifting cable of shifting mechanism of the bicycle 12 is connected with the derailleur 78 to allow shifting of the gears while operating the bicycle 12 to propel the watercraft 10.

Fixed to the outer ends of the front and rear outrigger arms 32, 33, 50 and 51 are a pair of laterally spaced floats 80 and 82 suitably sized and constructed to buoyantly support the entire assembly comprising the watercraft 10, together with a rider.

The bicycle 12 is simply assembled to the main framework 30 by placing the front wheel 28 in channel member 36 and the rear wheel 29 in channel 56. Struts 44 and 46 would be fixed to the horizontal cross-bar of the frame 14 and struts 60 and 61 secured to the hub of rear wheel 29 after brackets 62 and 63 are placed on the hub. Drive chain 20 would be removed from the gear train 18 of the bicycle 12 and connected through derailleur 78 to the gear train 76 on the drive shaft 70 of the paddle assemblies 72 and 74. The gear shaft cable would be disassembled from the derailleur of the bicycle and assembled to derailleur 78.

The rider would be ready to mount the bicycle 12 to operate it for propelling the watercraft 10 through a body of water. The rider may shift speeds of the gear train 76 by merely actuating the shift mechanism 26 on the frame 14 of the bicycle 12.

While I have shown and described a present preferred embodiment of this invention, it is to be distinctly understood that the invention is not limited thereto, but maybe otherwise embodied within the scope of the following claims.

I claim:

1. A bicycle watercraft assembly comprising:

a conventional bicycle having a drive assembly including gears connected by a drive chain, a steerable front wheel, rear wheel, and a frame interconnecting the drive assembly and wheels:

a main framework rigidly holding said bicycle in place, said main framework comprising a forward section including laterally extending first outrigger arms and a centrally disposed front channel pivotably supported by said first outrigger arms for snugly receiving and holding the front wheel of said bicycle; a rearward section including laterally extending second outrigger arms and a centrally disposed rear channel supported by said second outrigger arms for snugly receiving and holding the rear wheel of said bicycle;

front strut means extending from said first outrigger arms to an upper portion of said frame of said bicycle for supporting said bicycle on said framework;

rear strut means extending from said second outrigger arms to a rear portion of said frame of said bicycle for supporting said bicycle on said framework;

rider-operated propulsion means secured by said outrigger arms;

steering means operatively connected with said front channel;

gear means operatively connected with said propulsion means and said drive chain of said bicycle for imparting a rider motivated driving force from said bicycle to said propulsion;

said gear means including a series of increased diameter speed gears;

said bicycle including rider-operated gear shifting means operatively connected with said gear means for shifting said gear means; and a pair of laterally spaced floats secured to the outer end portions of said first and second outrigger arms for buoyantly supporting said bicycle and main framework.

2. A bicycle watercraft assembly as set forth in claim 1 wherein said front strut means are selectively adjustable in length for supporting bicycles of differing frame sizes.

3. A bicycle watercraft assembly as set forth in claim 1 wherein said rear strut members are selectively adjustable in length for supporting bicycles of differing frame sizes.

4. A bicycle watercraft assembly comprising:

a conventional bicycle having a drive assembly including gears connected by a drive chain, a steerable front wheel, rear wheel, and a frame interconnecting the drive assembly and wheels:

a main framework rigidly holding said bicycle in place, said main framework comprising a forward section including laterally extending first outrigger arms and a centrally disposed front channel pivotably supported by said first outrigger arms for snugly receiving and holding the front wheel of said bicycle; a rearward section including laterally extending second outrigger arms and a centrally disposed rear channel supported by said second outrigger arms for snugly receiving and holding the rear wheel of said bicycle;

front strut means extending from said first outrigger arms to an upper portion of said frame of said bicycle for supporting said bicycle on said framework;

rear strut means extending from said second outrigger arms to a rear portion of said frame of said bicycle for supporting said bicycle on said framework;

rider-operated propulsion means secured by said outrigger arms;

steering means operatively connected with said front channel;

gear means operatively connected with said propulsion means and said drive chain of said bicycle for imparting a rider motivated driving force from said bicycle to said propulsion means;

a pair of laterally spaced floats secured to the outer end portions of said first and second outrigger arms for buoyantly supporting said bicycle and main framework; and said front channel of said main framework being slideably supported for selective movement frontwardly and rearwardly with respect to said front outrigger arm.

5. A bicycle watercraft assembly comprising:

a conventional bicycle having a drive assembly including gears connected by a drive chain, a steerable front wheel, rear wheel, and a frame interconnecting the drive assembly and wheels:

a main framework rigidly holding said bicycle in place, said main framework comprising a forward section including laterally extending first outrigger arms and a centrally disposed front channel pivotably supported by said first outrigger arms for snugly receiving and holding the front wheel of said bicycle; a rearward section including laterally extending second outrigger arms and a centrally disposed rear channel supported by said second outrigger arms for snugly receiving and holding the rear wheel of said bicycle;

said main framework, including bracket means adjustable in length supported on said second outrigger arms and secured to said frame of said bicycle at the hub of said rear wheel for securing said bicycle against rearward movement when said bicycle is being operated;

front strut means extending from said first outrigger arms to an upper portion of said frame of said bicycle for supporting said bicycle on said framework;

rear strut means extending from said second outrigger arms to a rear portion of said frame of said bicycle for supporting said bicycle on said framework;

rider-operated propulsion means secured by said outrigger arms;

steering means operatively connected with said front channel;

gear means operatively connected with said propulsion means and said drive chain of said bicycle for imparting a rider motivated driving force from said bicycle to said propulsion means; and a pair of laterally spaced floats secured to the outer end portions of said first and second outrigger arms for buoyantly supporting said bicycle and main framework.

6. A bicycle watercraft assembly comprising:

a conventional bicycle having a drive assembly including gears connected by a drive chain, a steerable front wheel, rear wheel, and a frame interconnecting the drive assembly and wheels:

a main framework rigidly holding said bicycle in place, said main framework comprising a forward section including laterally extending first outrigger arms and a centrally disposed front channel pivotably supported by said first outrigger arms for snugly receiving and holding the front wheel of said bicycle; a rearward section including laterally extending second outrigger arms and a centrally disposed rear channel supported by said second outrigger arms for snugly receiving and holding the rear wheel of said bicycle;

front strut means extending from said first outrigger arms to an upper portion of said frame of said bicycle for supporting said bicycle on said framework;

rear strut means extending from said second outrigger arms to a rear portion of said frame of said bicycle for supporting said bicycle on said framework;

rider-operated propulsion means secured by said outrigger arms;

steering means operatively connected with said front channel;

said steering means being selectively vertically adjustable with respect to said first outrigger arms;

gear means operatively connected with said propulsion means and said drive chain of said bicycle for imparting a rider motivated driving force from said bicycle to said propulsion means; and a pair of laterally spaced floats secured to the outer end portions of said first and second outrigger arms for buoyantly supporting said bicycle and main framework.

* * * * *